US006595007B2

(12) United States Patent
Amano

(10) Patent No.: US 6,595,007 B2
(45) Date of Patent: Jul. 22, 2003

(54) STIRLING REFRIGERATING MACHINE

(75) Inventor: Shinsuke Amano, Kobe (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/168,344

(22) PCT Filed: Dec. 18, 2000

(86) PCT No.: PCT/JP00/08975

§ 371 (c)(1),
(2), (4) Date: Jun. 20, 2002

(87) PCT Pub. No.: WO01/46627

PCT Pub. Date: Jun. 28, 2001

(65) Prior Publication Data

US 2003/0000226 A1 Jan. 2, 2003

(30) Foreign Application Priority Data

Dec. 21, 1999 (JP) ..... 11/363079

(51) Int. Cl.[7] ..... F25B 9/00
(52) U.S. Cl. ..... 62/6
(58) Field of Search ..... 62/6; 165/4, 10

(56) References Cited

U.S. PATENT DOCUMENTS 4,195,482 A * 4/1980 Moloney ..... 60/517
4,702,903 A * 10/1987 Keefer ..... 423/359
5,301,506 A * 4/1994 Pettingill ..... 62/6
6,161,389 A * 12/2000 Sekiya et al. ..... 62/6

FOREIGN PATENT DOCUMENTS

| | | |
|---|---|---|
| JP | 51-13900 | 5/1976 |
| JP | 63-99463 A | 4/1988 |
| JP | 5-296587 A | 11/1993 |
| JP | 6-159828 A | 6/1994 |
| JP | 6-323658 A | 11/1994 |

* cited by examiner

*Primary Examiner*—Denise L. Esquivel
*Assistant Examiner*—Malik N. Drake
(74) *Attorney, Agent, or Firm*—Birch, Stewart, Kolasch & Birch, LLP

(57) ABSTRACT

A Stirling refrigerating machine, comprising a regenerator provided in a flow path for a working medium reciprocating between an expansion space and a compression space formed in a cylinder, wherein a flow strengthener making uniform the flow of the working medium passing through the regenerator is provided on one or both of the expansion and compression space sides of the regenerator, whereby, because the nonuniformity of the flow of the working medium passing through the regenerator is improved, a regenerated heat exchanging efficiency can be increased, and thus the performance of the refrigerating machine can be increased.

14 Claims, 2 Drawing Sheets

STIRLING REFRIGERATING MACHINE

This application is the national phase under 35 U.S.C. §371 of PCT International Application No. PCT/JP00/08975 which has an International filing date of Dec. 18, 2000, which designated the United States of America.

TECHNICAL FIELD

The present invention relates to a Stirling refrigerating machine.

BACKGROUND ART

FIG. 3 is a sectional view schematically showing an example of a conventional Stirling refrigerating machine. First, the structure of this conventional Stirling refrigerating machine will be described with reference to FIG. 3. A cylinder 1 has a cylindrical space formed inside it, and, in this space, a displacer 2 and a piston 3 are arranged so as to form a compression space 6 and an expansion space 7, between which a regenerator 8 is provided to form a closed circuit. This closed circuit has its working space filled with working gas such as helium, and the piston 3 is made to reciprocate along its axis (in the direction marked F) by an external power source such as a linear motor (not shown) or the like. The reciprocating movement of the piston 3 causes periodic pressure variations in the working gas sealed in the working space, and causes the displacer 2 to reciprocate along its axis.

A displacer rod 4 penetrating the piston 3 is, at one end, fixed to the displacer 2 and, at the other end, connected to a spring 5. The displacer 2 reciprocates along its axis inside the cylinder 1 with the same period as but with a different phase from the piston 3. As the displacer 2 and the piston 3 move with an appropriate phase difference kept between them, the working gas sealed in the working space forms a thermodynamic cycle well-known as the reversed Stirling cycle, and produces cold mainly in the expansion space 7.

The regenerator 8 is a matrix of fine wire or a ring-shaped gap formed by wounding foil. As the working gas moves from the compression space 6 to the expansion space 7, the regenerator 8 receives heat from the working gas and stores the heat. As the working gas returns from the expansion space 7 to the compression space 6, the regenerator 8 returns the heat stored in it to the working gas. Thus, the regenerator 8 serves to store heat.

Reference numeral 9 represents a high-temperature-side heat exchanger, through which part of the heat generated when the working gas is compressed in the compression space is rejected to outside. Reference numeral 10 represents a low-temperature-side heat exchanger, through which heat is taken in from outside when the working gas expands in the expansion space 7.

Now, how this structure works will be described briefly below. When compressed by the piston 3, the working gas in the compression space 6 moves, as indicated by the solid-line arrow A in the figure, through the regenerator 8 to the expansion space 7. Meanwhile, the heat of the working gas is rejected through the high-temperature-side heat exchanger 9 to outside, and thus the working gas is pre-cooled as the result of its heat being stored in the regenerator 8. When most of the working gas has flowed into the expansion space 7, it starts expanding, and produces cold in the expansion space 7.

Next, the working gas moves, as indicated by the broken-line arrow B in the figure, through the regenerator 8 back to the compression space 6. Meanwhile, the working gas takes in heat from outside through the low-temperature-side heat exchanger 10, and collects the heat stored in the regenerator 8 half a cycle ago before entering the compression space 6. When most of the working gas has returned to the compression space 6, it starts being compressed again, and thus proceeds to the next cycle. This cycle is repeated continuously, and cryogenic cold is thereby produced.

In this structure, the regenerator 8 is realized, for example, with film of polyester or the like wound in a cylindrical shape. However, here, variations are inevitable in the gaps between different layers of the film so wound, and therefore, when such a regenerator is incorporated in a Stirling refrigerating machine, most of the working gas flows through where the gaps are relatively large, and little of it flows elsewhere, making the flow of the working gas through the regenerator 8 uneven. This makes it impossible to use the whole regenerator 8 effectively for heat storage, and thus lowers regenerated heat exchange efficiency, degrading the performance of the Stirling refrigerating machine.

The working gas sealed in the cylinder 1 sometimes contains moisture, and the moisture may freeze inside the expansion space 7 and stick to the displacer 2, causing friction between the displacer 2 and the cylinder 1 and thereby hindering smooth sliding. This, too, degrades the performance of the Stirling refrigerating machine.

The moisture may also condense inside the expansion space 7 and flow into the gaps between different layers of the film, hindering the flow of the working gas through those gaps and thereby making it impossible to use the whole regenerator 8 effectively for heat storage. This, too, degrades the performance of the Stirling refrigerating machine.

DISCLOSURE OF INVENTION

An object of the present invention is to provide a Stirling refrigerating machine in which the unevenness of the flow of the working gas passing through the regenerator has been alleviated to achieve higher regenerated heat exchange efficiency. Another object of the present invention is, in a Stirling refrigerating machine, to remove moisture contained in the working gas and thereby prevent degradation of the performance of the Stirling refrigerating machine resulting from condensation or freezing of the moisture. Still another object of the present invention is, in a Stirling refrigerating machine, to remove impurities contained in the working gas and thereby prevent clogging of the regenerator caused by the impurities.

To achieve the above objects, according to the present invention, a Stirling refrigerating machine is provided with: a piston and a displacer provided coaxially inside a single cylinder and reciprocating axially inside the cylinder with identical periods but with different phases; an expansion space formed by partitioning off one end portion of the inside of the cylinder with the displacer; a compression space formed by partitioning off a middle portion of the inside of the cylinder with the displacer and the piston; and a regenerator provided in the flow path for a working medium formed between the outside of the movement path of the displacer and the inner surface of the cylinder. Here, uniformizing means for making the flow of the working medium passing through the regenerator uniform is provided on one or both of the expansion-space and compression-space sides of the regenerator.

In this structure, the working medium reciprocating between the expansion space and the compression space passes through the flow uniformizing means immediately before flowing into the regenerator. The flow uniformizing means makes the flow of the working medium passing through the regenerator uniform.

Alternatively, moisture absorbing means for removing moisture contained in the working medium is provided on one or both of the expansion-space and compression-space sides of the regenerator.

In this structure, the working medium reciprocating between the expansion space and the compression space passes through the moisture absorbing means immediately before flowing into the regenerator. The moisture absorbing means removes moisture contained in the working medium.

Alternatively, a filter for removing impurities contained in the working medium is provided on one or both of the expansion-space and compression-space sides of the regenerator.

In this structure, the working medium reciprocating between the expansion space and the compression space passes through the filter immediately before flowing into the regenerator. The filter removes impurities contained in the working medium.

Alternatively, flow uniformizing means shared as moisture absorbing means for making the flow of the working medium passing through the regenerator uniform and for removing moisture contained in the working medium is provided on one or both of the expansion-space and compression-space sides of the regenerator.

In this structure, the working medium reciprocating between the expansion space and the compression space passes through the flow uniformizing means shared as moisture absorbing means immediately before flowing into the regenerator. The flow uniformizing means shared as moisture absorbing means makes the flow of the working medium passing through the regenerator uniform and removes moisture contained in the working medium.

Alternatively, flow uniformizing means shared as a filter for making the flow of the working medium passing through the regenerator uniform and for removing impurities contained in the working medium is provided on one or both of the expansion-space and compression-space sides of the regenerator.

In this structure, the working medium reciprocating between the expansion space and the compression space passes through the flow uniformizing means shared as a filter immediately before flowing into the regenerator. The flow uniformizing means shared as a filter makes the flow of the working medium passing through the regenerator uniform and removes impurities contained in the working medium Alternatively, moisture absorbing means shared as a filter for removing moisture and impurities contained in the working medium is provided on one or both of the expansion-space and compression-space sides of the regenerator.

In this structure, the working medium reciprocating between the expansion space and the compression space passes through the moisture absorbing means shared as a filter immediately before flowing into the regenerator. The moisture absorbing means shared as a filter removes moisture and impurities contained in the working medium.

Alternatively, flow uniformizing means shared as moisture absorbing means and as a filter for making the flow of the working medium passing through the regenerator uniform and for removing moisture and impurities contained in the working medium is provided on one or both of expansion-space and compression-space sides of the regenerator.

In this structure, the working medium reciprocating between the expansion space and the compression space passes through the flow uniformizing means shared as moisture absorbing means and as a filter immediately before flowing into the regenerator. The flow uniformizing means shared as moisture absorbing means and as a filter makes the flow of the working medium passing through the regenerator uniform and removes moisture and impurities contained in the working medium.

The flow uniformizing means, moisture absorbing means, filter, flow uniformizing means shared as moisture absorbing means, flow uniformizing means shared as a filter, moisture absorbing means shared as a filter, or flow uniformizing means shared as moisture absorbing means and as a filter may be made of a material having an adequate heat capacity, so that they are given the ability to store a certain amount of heat.

BEST MODE FOR CARRYING OUT THE INVENTION

Figure 1:
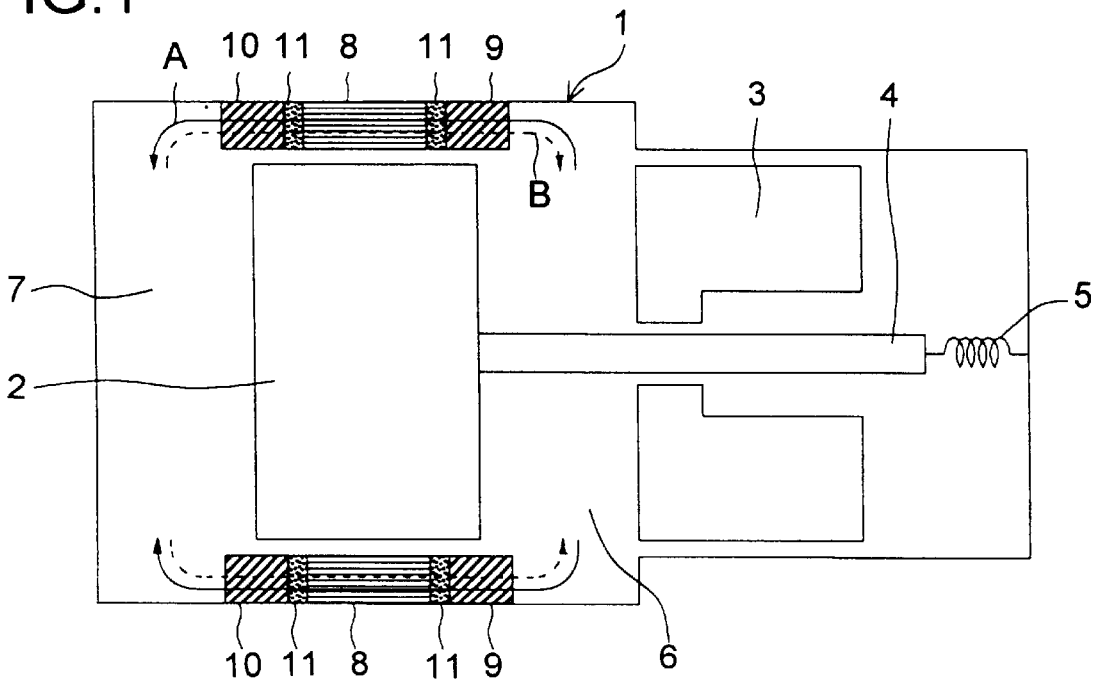
FIG. 1 is a sectional view schematically showing a Stirling refrigerating machine according to the invention.
Figure 2:
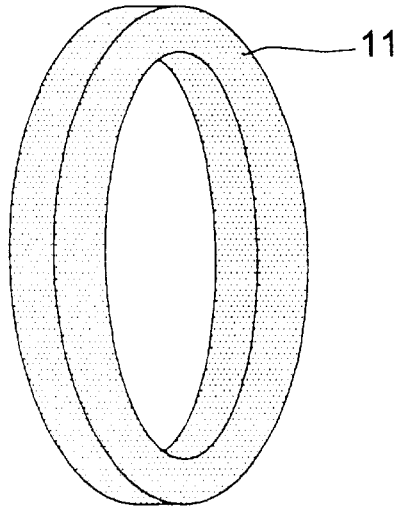
FIG. 2 is a perspective view of the flow uniformizer used in the Stirling refrigerating machine according to the invention.

Hereinafter, an embodiment of the present invention will be described with reference to the drawings. FIG. 1 is a sectional view schematically showing a Stirling refrigerating machine according to the invention, and FIG. 2 is a perspective view of the flow uniformizer used in the Stirling refrigerating machine according to the invention. It is to be noted that, in FIG. 1, such members as are found also in the conventional Stirling refrigerating machine shown in FIG. 3 are identified with the same reference numerals, and their detailed explanations will be omitted.

Figure 3:
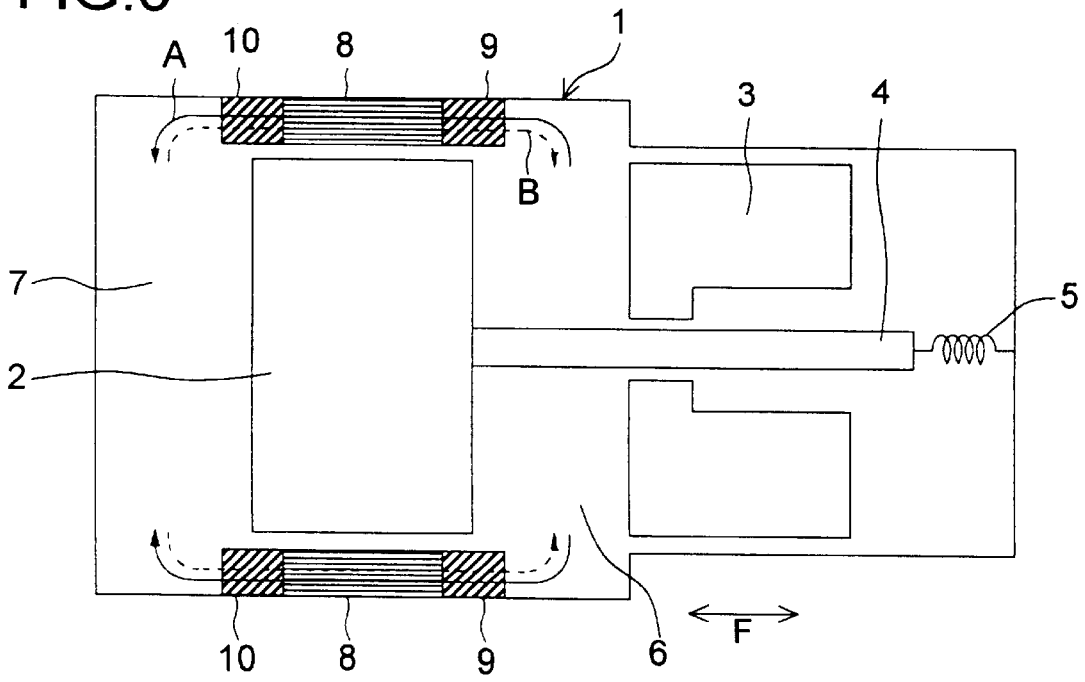
FIG. 3 is a sectional view schematically showing an example of a conventional Stirling refrigerating machine.

The structure shown in FIG. 1 differs from that of the conventional Stirling refrigerating machine shown in FIG. 3 only in that flow uniformizers 11 are additionally provided contiguous with the regenerator 8, one on the expansion space 7 side thereof and another on the compression space 6 side thereof. As shown in FIG. 2, the flow uniformizer 11 according to the invention is a doughnut-shaped member having a thickness of about 1 mm to 5 mm. The flow uniformizer 11 is a filter made of, for example, polyurethane foam, and the fineness of its mesh is so set as to produce the desired pressure loss between the compression space 6 and the expansion space 7 when the flow path for the working gas is formed by coupling the regenerator 8, high-temperature-side heat exchanger 9, low-temperature-side heat exchanger 10, and flow uniformizer 11 together.

When the Stirling refrigerating machine structured in this way is operated, as indicated by the arrow A or B in the figure, the working gas moves from one of the compression space 6 and the expansion space 7 to the other. Meanwhile, the flow uniformizer 11, which provides resistance to the working gas passing through it, makes the working gas disperse all around the flow uniformizer 11 while passing through it. Thus, after passing through the flow uniformizer 11, the working gas has substantially uniform flow speed at the entrance of the regenerator 8. Thus, the flow uniformizer 11, by making the working gas flow uniformly all around the regenerator 8, achieves an adequate flow uniformizing effect.

Table 1 shows the coefficient of performance (COP) of the Stirling refrigerating machine as observed when the flow uniformizers 11 are provided and when they are not (i.e. as in the conventional example shown in FIG. 3). Here, the temperature conditions are assumed to be 30° C. at the high-temperature side (compression space 6 side) and −23° C. at the low-temperature side (expansion space 7 side).

TABLE 1

| Flow Uniformizers | COP (−23° C. at low-temperature side, 30° C. at high-temperature side) |
|---|---|
| Provided | 0.89 |
| Not Provided | 0.66 |

Table 1 clearly shows that providing the flow uniformizers 11 makes the flow of the working gas passing through the regenerator 8 uniform, and thereby permits the whole regenerator 11 to be used effectively for heat storage, with the result that the Stirling refrigerating machine offers enhanced performance.

Needless to say, the flow uniformizers 11 may be made of any other material than polyurethane foam to achieve the same effects, as long as they have adequate mesh not to produce an extremely high pressure loss.

Incidentally, by making the flow uniformizers 11 of a highly moisture-absorbing, water-absorbing material, it is possible, in addition to making the flow of the working gas uniform, to remove moisture contained in the working gas.

Examples of such materials include: fiber of cotton, wool, silk, rayon, acetate, cellulose, hydrophilic or hydrophobic polyester, or moisture-absorbing or water-absorbing nylon; super absorbent high polymer materials such as fiber based on cross-linked polyacrylates; and porous materials such as zeolite, silica, diatomaceous earth, allophane, alumina-silica, zirconium phosphate, and porous metal materials.

Of these materials, a material in fiber form is formed into a flat sheet, honeycomb, corrugate sheet, or the like; on the other hand, a material in non-fiber form is sintered into a doughnut shape, or its powder is sandwiched between pieces of nonwoven cloth together with a binder and fixed. In one of these ways, the moisture-absorbing flow uniformizer 11 shaped as shown in FIG. 2 can be easily produced.

The flow uniformizers 11 thus produced are dried to an adequate degree, and are then arranged inside the Stirling refrigerating machine as shown in FIG. 1. This makes it possible to absorb moisture contained in the working gas and, even if the moisture condenses, to absorb the water quickly. Thus, it is possible to prevent the moisture from freezing at the expansion space 7 side and sticking to the displacer 2 or the like, and thereby prevent degradation of the refrigerating performance of the Stirling refrigerating machine, or it is possible to prevent the moisture from condensing in the expansion space 7 and stopping the gaps between different layers of the film of the regenerator 8, and thereby prevent degradation of the refrigerating performance. Instead of giving a single flow uniformizer 11 both the ability to make working gas flow uniform and the ability to absorb moisture, it is also possible to build a flow uniformizer and a moisture-absorber each separately.

Moreover, by making the flow uniformizers 11 of zeolite, filter paper, or the like, it is possible, in addition to making the flow of the working gas uniform and absorbing moisture and water as described above, to absorb and remove impurities such as particles shaved off the components through which the working gas reciprocates or particles of a coating agent or the like flaked off the surface of those components. This makes it possible to prevent the impurities from causing the regenerator 8 to clog and degrading the performance of the Stirling refrigerating machine. Instead of giving a single flow uniformizer 11 the ability to make working gas flow uniform, the ability to absorb moisture, and the ability to filter out impurities all together, it is also possible to combine together two among a flow uniformizer, a moisture-absorber, and a filter, or to build them each separately.

Furthermore, by making the flow uniformizer 11 of a material having an adequate heat capacity (for example, a material based on polyester), it is possible to store heat not only in the regenerator 8 but, for a certain amount of heat, also in the flow uniformizer 11. This helps enhance regenerated heat exchange efficiency.

Although the embodiment described above deals with a case where flow uniformizers 11 are provided on both the expansion-space 7 and compression-space 6 sides of the regenerator 8, they do not necessarily have to be provided on both sides; that is, it is also possible to provide one flow uniformizer on one side. This helps reduce the number of components needed and thereby reduce costs.

Obviously, many modifications and variations of the present invention are possible in light of the above teachings. It is therefore to be understood that within the scope of the appended claims, the invention may be practiced other than as specifically described.

INDUSTRIAL APPLICABILITY

As described above, according to the present invention, flow uniformizing means for making the flow of a working medium uniform is provided contiguous with a regenerator forming a flow path of the working medium reciprocating between an expansion space and a compression space formed inside a cylinder of a Stirling refrigerating machine. This alleviates the unevenness of the flow of the working medium passing through the regenerator, leading to enhanced regenerated heat exchange efficiency and thus to enhanced performance of the Stirling refrigerating machine.

Moreover, according to the present invention, the flow uniformizing means is shared as moisture-absorbing means for removing moisture contained in the working medium. This makes it possible to prevent degradation of refrigerating performance resulting from the moisture freezing at the expansion space side, or to prevent degradation of refrigerating performance resulting from the moisture condensing in the expansion space and stopping the gaps between different layers of the film of the regenerator.

What is claimed is:

1. A Stirling refrigerating machine comprising:

a piston and a displacer provided coaxially inside a single cylinder and reciprocating axially inside the cylinder with identical periods but with different phases;

an expansion space formed by partitioning off one end portion of an inside of the cylinder with the displacer;

a compression space formed by partitioning off a middle portion of the inside of the cylinder with the displacer and the piston; and a regenerator provided in a flow path for a working medium formed between an outside of a movement path of the displacer and an inner surface of the cylinder, wherein flow uniformizing means for making flow of the working medium passing through the regenerator uniform is provided on one or both of expansion-space and compression-space sides of the regenerator.

2. A Stirling refrigerating machine as claimed in claim 1, wherein the flow uniformizing means is made of a material having an adequate heat capacity.

3. (Amended) A Stirling refrigerating machine comprising:

a piston and a displacer provided coaxially inside a single cylinder and reciprocating axially inside the cylinder with identical periods but with different phases;

an expansion space formed by partitioning off one end portion of an inside of the cylinder with the displacer;

a compression space formed by partitioning off a middle portion of the inside of the cylinder with the displacer and the piston; and a regenerator provided in a flow path for a working medium formed between an outside of a movement path of the displacer and an inner surface of the cylinder, wherein moisture absorbing means for removing moisture contained in the working medium is provided on one or both of expansion-space and compression-space sides of the regenerator.

4. A Stirling refrigerating machine as claimed in claim 3, wherein the flow uniformizing means is made of a material having an adequate heat capacity.

5. (Amended) A Stirling refrigerating machine comprising:

a piston and a displacer provided coaxially inside a single cylinder and reciprocating axially inside the cylinder with identical periods but with different phases;

an expansion space formed by partitioning off one end portion of an inside of the cylinder with the displacer;

a compression space formed by partitioning off a middle portion of the inside of the cylinder with the displacer and the piston; and a regenerator provided in a flow path for a working medium formed between an outside of a movement path of the displacer and an inner surface of the cylinder, wherein a filter for removing impurities contained in the working medium is provided on one or both of expansion-space and compression-space sides of the regenerator.

6. A Stirling refrigerating machine as claimed in claim 5, wherein the flow uniformizing means is made of a material having an adequate heat capacity.

7. (Amended) A Stirling refrigerating machine comprising:

a piston and a displacer provided coaxially inside a single cylinder and reciprocating axially inside the cylinder with identical periods but with different phases;

an expansion space formed by partitioning off one end portion of an inside of the cylinder with the displacer;

a compression space formed by partitioning off a middle portion of the inside of the cylinder with the displacer and the piston; and a regenerator provided in a flow path for a working medium formed between an outside of a movement path of the displacer and an inner surface of the cylinder, wherein flow uniformizing means shared as moisture absorbing means for making flow of the working medium passing through the regenerator uniform and for removing moisture contained in the working medium is provided on one or both of expansion-space and compression-space sides of the regenerator.

8. A Stirling refrigerating machine as claimed in claim 7, wherein the flow uniformizing means shared as moisture absorbing means is made of a material having an adequate heat capacity.

9. (Amended) A Stirling refrigerating machine comprising:

a piston and a displacer provided coaxially inside a single cylinder and reciprocating axially inside the cylinder with identical periods but with different phases;

an expansion space formed by partitioning off one end portion of an inside of the cylinder with the displacer;

a compression space formed by partitioning off a middle portion of the inside of the cylinder with the displacer and the piston; and a regenerator provided in a flow path for a working medium formed between an outside of a movement path of the displacer and an inner surface of the cylinder, wherein flow uniformizing means shared as a filter for making flow of the working medium passing through the regenerator uniform and for removing impurities contained in the working medium is provided on one or both of expansion-space and compression-space sides of the regenerator.

10. A Stirling refrigerating machine as claimed in claim 9, wherein the flow uniformizing means shared as a filter is made of a material having an adequate heat capacity.

11. (Amended) A Stirling refrigerating machine comprising:

a piston and a displacer provided coaxially inside a single cylinder and reciprocating axially inside the cylinder with identical periods but with different phases;

an expansion space formed by partitioning off one end portion of an inside of the cylinder with the displacer;

a compression space formed by partitioning off a middle portion of the inside of the cylinder with the displacer and the piston; and a regenerator provided in a flow path for a working medium formed between an outside of a movement path of the displacer and an inner surface of the cylinder, wherein moisture absorbing means shared as a filter for removing moisture and impurities contained in the working medium is provided on one or both of expansion-space and compression-space sides of the regenerator.

12. A Stirling refrigerating machine as claimed in claim 11, wherein the moisture absorbing means shared as a filter is made of a material having an adequate heat capacity.

13. (Amended) A Stirling refrigerating machine comprising:

a piston and a displacer provided coaxially inside a single cylinder and reciprocating axially inside the cylinder with identical periods but with different phases;

an expansion space formed by partitioning off one end portion of an inside of the cylinder with the displacer;

a compression space formed by partitioning off a middle portion of the inside of the cylinder with the displacer and the piston; and a regenerator provided in a flow path for a working medium formed between an outside of a movement path of the displacer and an inner surface of the cylinder, wherein flow uniformizing means shared as moisture absorbing means and as a filter for making flow of the working medium passing through the regenerator uniform and for removing moisture and impurities contained in the working medium is provided on one or both of expansion-space and compression-space sides of the regenerator.

14. A Stirling refrigerating machine as claimed in claim 13, wherein the flow uniformizing means shared as moisture absorbing means and as a filter is made of a material having an adequate heat capacity.

* * * * *